US012653335B1

(12) United States Patent
Nunez

(10) Patent No.: US 12,653,335 B1
(45) Date of Patent: Jun. 16, 2026

(54) STRUCTURALLY STABLE MODULAR ORGANIZER

(71) Applicant: Elsa Dumplet Nunez, Coram, NY (US)

(72) Inventor: Elsa Dumplet Nunez, Coram, NY (US)

( * ) Notice: Subject to any disclaimer, the term of this patent is extended or adjusted under 35 U.S.C. 154(b) by 0 days.

(21) Appl. No.: 19/278,848

(22) Filed: Jul. 24, 2025

(51) Int. Cl.
*A47G 25/14* (2006.01)

(52) U.S. Cl.
CPC ..... *A47G 25/14* (2013.01)

(58) Field of Classification Search
CPC ..... A47G 25/14; A47G 25/32; A47G 25/18; A47F 5/0006; A47B 57/408; A47B 43/006; A47B 57/40; A47B 57/404; A47B 47/00
See application file for complete search history.

(56) References Cited

U.S. PATENT DOCUMENTS 1,816,705 A * 7/1931 Traylor et al. ..... A47B 43/006 108/1
2,556,105 A * 6/1951 Rhett ..... A47B 43/006 108/106
4,317,522 A * 3/1982 Garrett ..... A47F 5/0892 211/113
4,388,982 A * 6/1983 Yonahara ..... E04G 3/20 182/115
5,749,479 A * 5/1998 Belokin ..... A47F 5/0892 211/113
6,076,685 A * 6/2000 Ramirez ..... A47F 5/0006 211/85.3
6,116,164 A * 9/2000 Justen, Jr. ..... A47B 43/006 211/113
6,126,237 A * 10/2000 Ritterhouse ..... A47C 7/383 297/410
6,595,145 B1 * 7/2003 Lietz ..... A47B 43/006 108/106
7,293,664 B2 * 11/2007 Belokin ..... A47F 5/0892 211/113
8,783,529 B2 * 7/2014 Dumplet Nunez ... A47F 5/0006 211/113
2007/0102380 A1 * 5/2007 Shaw ..... A47F 7/0035 211/85.7

* cited by examiner

*Primary Examiner* — Ko H Chan
(74) *Attorney, Agent, or Firm* — Shlomo Horowitz; Shlomo Horowitz Patents and Intelectual Property Ltd

(57) ABSTRACT

A modular organizer comprises two chains and a series of shoulder piece assemblies made of first and second shoulder pieces having an elongated body, a first arcuate end and a second arcuate end. The shoulder piece assembly may appear as a substantially flat ellipse. Each elongated body of at least a plurality of shoulder piece assemblies may traverse an aperture in a link of the chain. The uppermost shoulder piece is rigidly affixed by a first twist tie to the first chain and by a second twist tie to the second chain. The lowermost shoulder piece is rigidly affixed by a third twist tie to the first chain and by a fourth twist tie to the second chain. The ties are inserted through apertures of the shoulder pieces at a time when the shoulder piece has been inserted through an aperture defined by a chain link of the chain(s).

22 Claims, 5 Drawing Sheets

STRUCTURALLY STABLE MODULAR ORGANIZER

FIELD OF THE INVENTION

The invention is in the field of organizers, and in particular sturdy modular organizers.

BACKGROUND OF THE INVENTION

Many residences have a shortage of closet space for clothing. The lack of space for organizing clothing and other articles leads to overpacking of luggage for travel. This costs a lot of extra travel duties. Not having fully organized apparel, accessories and other articles also increases the time and burden of packing and hence of travelling.

In addition, many accessories and articles do not fit neatly into cubbies. Furthermore, traditional cubic-shaped organizers of folder clothing are not portable and occupy a lot of three-dimensional space in an apartment. They do not lend themselves to being positioned other than in specific places in a room. Furthermore, many prior art home organizers are expensive or complicated to install and in some case would require a contractor to physically install in the home. For example, large, complex dangle products are expensive to produce and install.

Many consumers also want their homes to have products in their homes to be ecologically friendly, for example by reducing carbon emissions.

SUMMARY OF THE EMBODIMENTS

Applicant has discovered that while the Modular Organizer of U.S. Pat. No. 8,783,529 (which U.S. Pat. No. 8,783,529 issued Jul. 22, 2014 is herein incorporated by reference in its entirety) is effective, after a significant period of time its structural integrity declines, it becomes unbalanced and its overall effectiveness is reduced. Specifically, it wobbles and loosens and the chains start to separate from the shoulder pieces. As a result, it may eventually become unsafe to store large amounts of clothing and other accessories.

One embodiment is a modular organizer with two chains that has structural integrity, comprising:

a first chain running along a first vertical axis;

a second chain running along a second vertical axis substantially parallel to the first vertical axis, a plurality of shoulder piece assemblies separable from the first and second chains, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing apertures in corresponding links of the first and second chains, wherein the plurality of shoulder piece assemblies include an uppermost shoulder piece that traverses a left aperture of an upper link in the first chain and a right aperture in the upper link of the second chain and includes a lowermost shoulder piece that traverses a left aperture of a lower link in the first chain and a right aperture in the lower link of the second chain, the first chain, the second chain and the plurality of shoulder piece assemblies defining a plane containing the first vertical axis and the second vertical axis, the uppermost shoulder piece is rigidly affixed by a first twist tie to the first chain and by a second twist tie to the second chain, a lowermost shoulder piece is rigidly affixed by a third twist tie to the first chain and by a fourth twist tie to the second chain, wherein the first twist tie, the second twist tie, the third twist tie and the fourth twist tie are made from a material that is configured to inelastically deform so as to attach a first portion of the first twist tie to a second portion of the first twist tie, attach a first portion of the second twist tie to a second portion the second twist tie, attach a first portion of the third twist tie to a second portion of the third twist tie and attach a first portion of the fourth twist tie to a second portion of the fourth twist tie.

In some embodiments, the first twist tie traverses an aperture of the uppermost shoulder piece adjacent the upper link in the first chain while the uppermost shoulder piece traverses the upper link in the first chain, wherein the aperture in the uppermost shoulder piece is within a centimeter of an opening in the upper chain. In some embodiments, the second twist tie traverses the right aperture in the upper link of the second chain.

In some embodiments, the second twist tie traverses the right aperture in the upper link of the second chain.

In some embodiments, the third twist tie traverses the left aperture of the lower link in the first chain. In some embodiments, the fourth twist tie traverses the right aperture in the lower link in the second chain.

In some embodiments, the fourth twist tie traverses the right aperture in the lower link in the second chain.

In some embodiments, the lower link means the lowest link traversed by a shoulder piece.

In some embodiments, the upper link means the highest link traversed by a shoulder piece.

In some embodiments, a first portion of the third twist tie traverses an aperture that the lower shoulder piece of the lowermost shoulder piece assembly traverses and a second portion of the third twist tie traverses a space in a link of the first chain. In some embodiments, a first portion of the fourth twist tie traverses an aperture that the lower shoulder piece traverses and a second portion of the fourth twist tie traverses a space in a link of the second chain.

In some embodiments, at least one of the twist ties comprises helical steel.

In some embodiments, at least one of the twist ties has a diameter of from 19 AWG to 31 AWG (0.2 mm to 0.9 mm).

In some embodiments, each of the first twist tie, the second twist tie, the third twist tie and the fourth twist tie has a diameter of from 19 AWG to 31 AWG (0.2 mm to 0.9 mm).

In some embodiments, the material is steel or aluminum.

In some embodiments, each of the first twist tie, the second twist tie, the third twist tie and the fourth twist tie are made of a material having a Young's modulus of 190-210 GPa.

In some embodiments, each of the first twist tie, the second twist tie, the third twist tie and the fourth twist tie are made of steel and have a Young's modulus of 190-210 GPa.

In some embodiments, each of the first twist tie, the second twist tie, the third twist tie and the fourth twist tie are made of steel and have a Young's modulus of 195-205 GPa.

In some embodiments, each of the first twist, the second twist tie, the third twist tie and the fourth twist tie are made of aluminum and have a Young's modulus of 60-80 GPa and wherein each of the first twist tie, the second twist tie, the third twist tie and the fourth twist tie are twisted with at least three twists.

In some embodiments, each of the first twist tie, the second twist tie, the third twist tie and the fourth twist tie are made of aluminum and have a Young's modulus of 65-75 GPa and wherein each of the first twist tie, the second twist tie, the third twist tie and the fourth twist tie have been twisted multiple times using at least three twists.

In some embodiments, each of the first twist tie, the second twist tie, the third twist tie and the fourth twist tie are made of aluminum and have a Young's modulus of 69-72 GPa and wherein each of the first twist tie, the second twist tie, the third twist tie and the fourth twist tie have been twisted multiple times using at least three twists.

In some embodiments, each of the first twist tie, the second twist tie, the third twist tie and the fourth twist tie have been twisted multiple times using at least three twists.

BRIEF DESCRIPTION OF THE DRAWINGS

Various embodiments are herein described, by way of example only, with reference to the accompanying drawings, wherein.

DETAILED DESCRIPTION OF THE EMBODIMENTS

Figure 1:
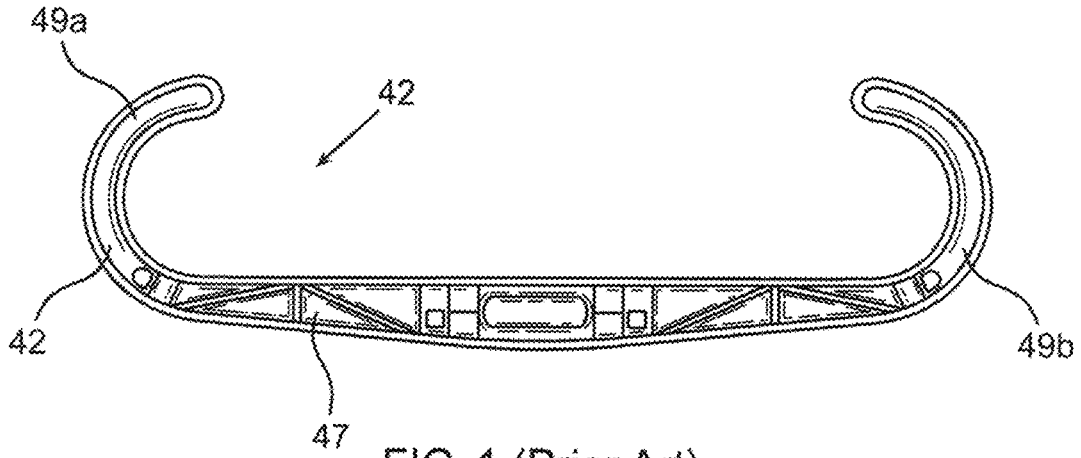
FIG. 1 (Prior Art)
FIG. 1 is a front view of a shoulder piece for an organizer, in accordance with one embodiment of U.S. Pat. No. 8,783,529.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Applicant has discovered that it is possible to have a modular organizer that endures in an effective state over a long period of time. After extensive experimentation Applicant discovered that the use of inelastic deformable ties that are positioned specifically to traverse the same chain links that the shoulder pieces traverse are the ideal way of maintaining structural integrity of the entire organizer.

In contrast to prior art apparatuses for hanging things, such as the apparatus described in U.S. Pat. No. 8,783,529, the stable modular organizer 10 herein maintains its structural stability over time despite holding as much as 40 or 60 pounds of clothing. In contrast to the previous organizer, the modular organizer stays safe over very long periods of time. In further contrast to the organizer of U.S. Pat. No. 8,783,529, the two vertical links of the modular organizer 10 do not change position and remain substantially parallel to one another over a very long period of time during which the organizer is used for holding clothing. In still further contrast to the organizer of U.S. Pat. No. 8,783,529, the two vertical links of the modular organizer 10 do not change orientation relative to the plane that the organizer sits in over a very extended period of use. In some embodiments, the bottom edges of each of the chains remain linearly aligned with the rest of the chain respectively even after an extended period of use. In some embodiments, in contrast to the prior art organizers, the organizer does not become wobbly and remains stable and sturdy.

In some embodiments, after repeated use of organizer over a long period of time including several years, a bottom link of the first chain (and a bottom link of the second chain) is configured to remain substantially colinear with each of the links in the first chain that are above that bottom link.

The principles and operation of a Structurally Stable Modular Organizer may be better understood with reference to the drawings and the accompanying description.

As shown in FIGS. 1-4, a modular organizer 10 may comprise a first chain 20, a second chain 30 and a plurality of shoulder piece assemblies 40 separable from the first and second chains. Each chain may have links that may have apertures or holes in the links. In some embodiments, the "plurality" of shoulder piece assemblies means at least seven. In other embodiments, this "plurality" means at least six, or at least five, or at least four, or at least three, or at least two. It could, of course, also mean a higher number than seven. This applies to all embodiments of organizers of the present invention.

Each shoulder piece assembly 40 may comprise a first shoulder piece 42 and a second shoulder piece 44. Each of the first and second shoulder pieces 42, 44 may comprise an elongated body 47, a first arcuate end 49 *a* and a second arcuate end 49 *b*. For example a shoulder piece assembly 40 may have on the left side of the organizer 10 a first arcuate end 49 *a* of the first shoulder piece 42 and a first arcuate end 49 *a* of the second shoulder piece 44. The two ends 49 *a* may overlap. The same shoulder piece assembly 40 may have on the right side of the organizer 10 a second arcuate end 49 *b* of the first shoulder piece 42 and a second arcuate end 49 *b* of the second shoulder piece 44 and the two ends 49 *b* may overlap. The first and second shoulder pieces 42, 44 may be separate pieces that may be held adjacent to one another but may be separable from one another.

Figure 2:
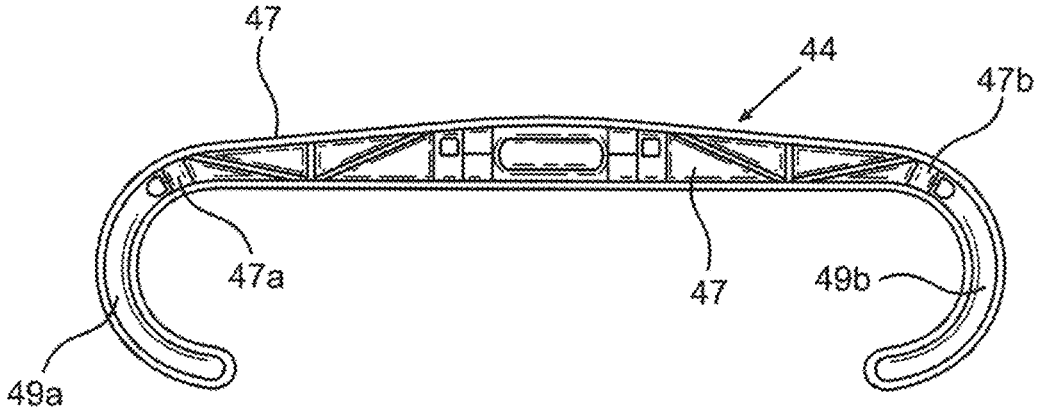
FIG. 2 (Prior Art)
FIG. 2 is a front view of a shoulder piece for an organizer, except pointing down, in accordance with one embodiment of U.S. Pat. No. 8,783,529.
Figure 3:
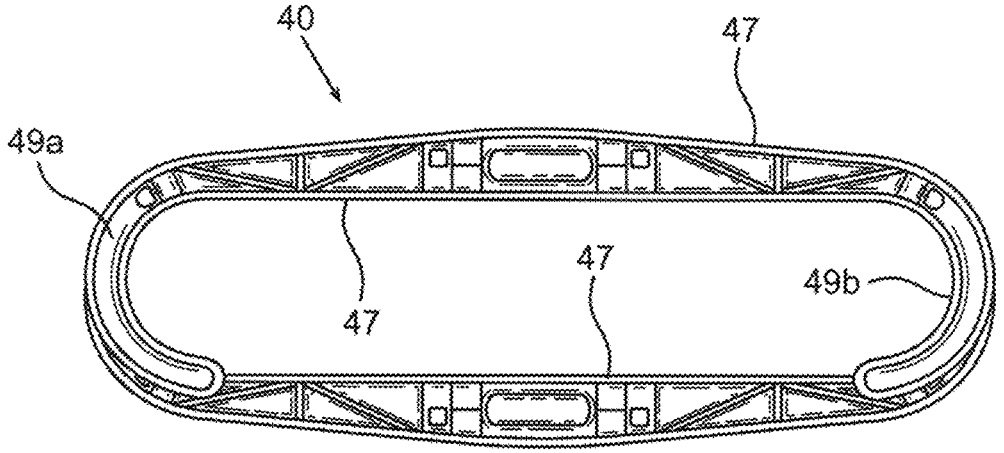
FIG. 3 (Prior Art)
FIG. 3 is a front view of a shoulder piece assembly, in accordance with one embodiment of U.S. Pat. No. 8,783,529.

As seen from the drawings, particularly FIGS. 1-2, "arcuate" ends may be described as hooks that are similar in shape to an umbrella handle. In some preferred embodiments, the arcuate ends may be less than a full semi-circle. In other preferred embodiments, the arcuate ends may be a full semi-circle or substantially semi-circular. In still other preferred embodiments, the arcuate ends may be J-shaped. In other preferred embodiments, the arcuate ends may be as shown in the drawings. In still other preferred embodiments, each of the arcuate ends may be less than 180 degrees in circular rotation (for example 120 degrees, 140 degrees, 160 degrees) provided that the arcuate end 49*a* of a first shoulder piece 42 overlaps with the arcuate end 49*b* of the second shoulder piece 44 of the same shoulder piece assembly 40 when the two shoulder pieces 42, 44 are placed adjacent one another, as they appear when in position for use, such as shown in the drawings.

The two shoulder pieces 42, 44 of shoulder piece assembly 40 need not be fixedly attached to one another although they may generally hang in a manner that may be adjacent to one another. In some embodiments, the shoulder pieces are fixedly attached to one another by a locking element, as shown in FIG. 5 through FIG. 10.

Although in some embodiments, each arcuate end of one shoulder piece 42, 44 may be similar or identical the arcuate end of the other shoulder piece of the shoulder piece assembly, there could be some variation if the overall shoulder piece assembly 40 is stable.

The first and second shoulder pieces 42, 44 of each shoulder piece assembly 40 may have opposing orientations such that one of the first and second shoulder pieces 42, 44 may have its arcuate ends 49 *a*, 49 *b* facing up and the other of the first and second shoulder pieces 42, 44 may have its arcuate ends 49 *a*, 49 *b* facing down. As can be seen from FIG. 4, the first arcuate end 49 *a* of the first shoulder piece 42 may be situated adjacent the first arcuate end 49 *a* of the second shoulder piece 44 of each shoulder piece assembly 40 (or, in other embodiments, of a majority, or of a plurality, or of fewer than every single shoulder piece assembly 40) and the second arcuate end 49 *b* of the first shoulder piece 42 situated adjacent the second arcuate end 49 *b* of the second shoulder piece 44 of each shoulder piece assembly (or, in other embodiments, of a majority, or of a plurality, or of fewer than every single shoulder piece assembly 40) so that the shoulder piece assembly 40 as a whole appears as a substantially flat ellipse. The two elongated bodies 47 may form two substantially parallel lines and the two pairs of arcuate ends may form arcs. Assembly 40 need not bulge out at its center like an ellipse but may be flatter. This may make it comfortable to hang articles of clothing, for example, on substantially straight elongated bodies 47 of assembly 40. In some embodiments, elongated bodies 47 are substantially straight.

In other embodiments, the elongated bodies 47 may be somewhat arced provided clothing, such as a pair of pants, would not slide off it. The typical way a pair of pants would be placed on the elongated body is that the pants would be folded along the creases and then neatly placed on the elongated body with the top of the pants hanging down one side and the bottom of the pants hanging down another side of the elongated body 47. As described below, an elastic band may hold the pants or other article to the elongated body.

Figure 4:
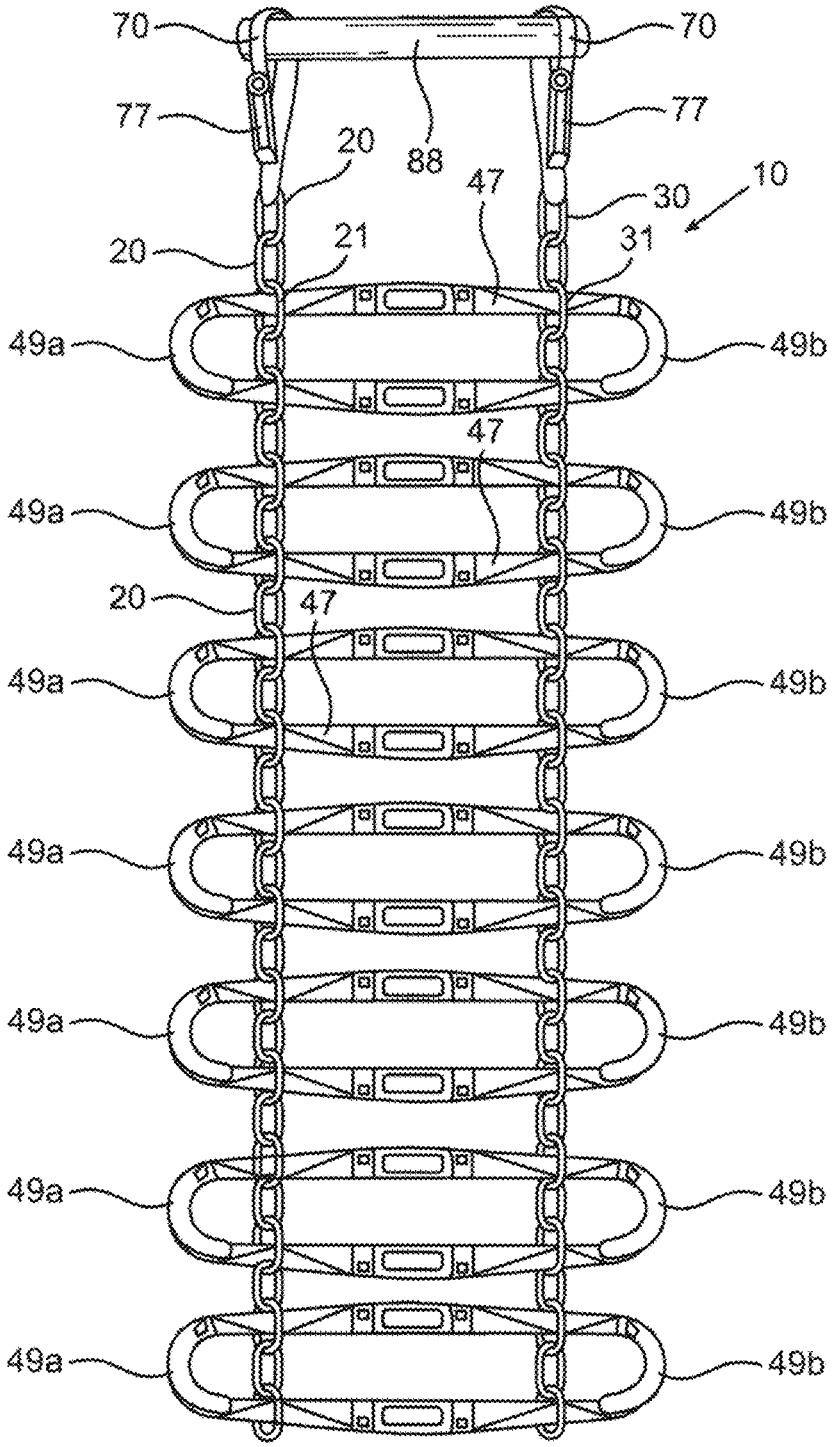
FIG. 4 (Prior Art)
FIG. 4 is a front view of an organizer, in accordance with one embodiment of U.S. Pat. No. 8,783,529.

As shown in FIG. 4, the plurality of shoulder piece assemblies 40 include an uppermost shoulder piece 44 (of an uppermost shoulder piece assembly 40) that traverses a left aperture defined by an upper link 21 in the first chain 20 (on the left as viewed by the user looking at the organizer 10) and traverses a right aperture defined by the upper link 31 of the second chain 30 (on the right as viewed by a user looking at the organizer 10).

The plurality of shoulder piece assemblies 40 also includes a lowermost shoulder piece 42 (of a lowermost shoulder piece assembly 40) that traverses a left aperture defined by a lower link 29 in the first chain 20 and traverses a right aperture defined by the lower link 39 of the second chain 30.

The term "upper link" 21, 31 of the first chain 20 or of the second chain 30 means the uppermost link (of the first chain 20 or of the second chain 30) that has a shoulder piece assembly 40 traversing it. The chains 20, 30 of organizer 10 may comprise other links above the upper link 21, 31 that are free of any shoulder piece assembly 40.

The term "lower link" 29, 39 of the first chain 20 or of the second chain 30 means the lowermost link (of the first chain 20 or of the second chain 30) that has a shoulder piece assembly 40 traversing it. The chains 20, 30 of organizer 10 may comprise other links below the lower link 29, 39 that are free of any shoulder piece assembly 40.

The term "twist tie" as used in this patent application means an inelastic metal wire (for example aluminum or galvanized steel) or an inelastic wire made of another material such as a polymeric material-encased in a thin strip of paper or plastic, or coated by a thin layer of plastic. The twist tie may or may not also be twisted into a helical shape before the encasing or the coating.

As a result of the twist ties fixedly tying the chains 20, 30 to upper and lower shoulder piece assemblies 40, for example to the uppermost and lowermost shoulder piece of the uppermost shoulder piece assembly 40 and the lower most shoulder piece assembly, the first chain 20, the second chain 30 and the plurality of shoulder piece assemblies 40 are secure and fixed.

In some embodiments, the shoulder piece assemblies 40 and the chains 20, 30 are positioned substantially in a plane. First chain 20 may be said to define a first vertical axis. Second chain 30 may be said to define a second vertical axis.

The upper shoulder piece 44 of the uppermost shoulder piece assembly 40 may be rigidly affixed by a first twist tie 51 to the first chain 20 and by a second twist tie 52 to the second chain 30.

The twist ties 51, 52, 53, 54 are used to traverse apertures in the respective shoulder pieces and attach the respective shoulder piece to the respective chain link either at a top portion of the respective chain or at a bottom portion of the respective chain.

In some embodiments, the first twist tie 51 traverses an aperture of the uppermost shoulder piece 44, the aperture being adjacent the upper link in the first chain at a time when the uppermost shoulder piece itself traverses the upper link in the first chain. In some embodiments "adjacent the upper link in the first chain" means that the aperture in the uppermost shoulder piece is within a centimeter of the aperture defined by the upper link of the first chain.

In this way the uppermost shoulder piece 44 of the uppermost shoulder piece assembly 40 is rigidly affixed to the first chain 20.

In some embodiments, the second twist tie 52 traverses an aperture of the uppermost shoulder piece, the aperture being adjacent the upper link in the second chain at a time when the uppermost shoulder piece itself traverses the upper link in the second chain. In some embodiments "adjacent the upper link in the second chain" means that the aperture in the uppermost shoulder piece is within a centimeter of the aperture defined by the upper link of the second chain.

In this way the uppermost shoulder piece 44 of the uppermost shoulder piece assembly 40 is rigidly affixed to the second chain 20.

In some embodiments, the third twist tie 53 traverses an aperture of the lowermost shoulder piece, the aperture being adjacent the lower link in the first chain at a time when the lowermost shoulder piece itself traverses the lower link in the first chain. In some embodiments "adjacent the lower link in the first chain" means that the aperture in the lowermost shoulder piece is within a centimeter of the aperture defined by the lower link of the first chain.

In this way the lowermost shoulder piece 42 of the uppermost shoulder piece assembly 40 is rigidly affixed to the first chain 20.

In some embodiments, the fourth twist tie 54 traverses an aperture of the lowermost shoulder piece, the aperture being adjacent the lower link in the first chain at a time when the lowermost shoulder piece itself traverses the lower link in the first chain. In some embodiments "adjacent the lower link in the first chain" means that the aperture in the lowermost shoulder piece is within a centimeter of the aperture defined by the lower link of the first chain.

In this way, the lowermost shoulder piece 42 of the lowermost shoulder piece assembly 40 is rigidly affixed to the second chain 20.

Figure 5:
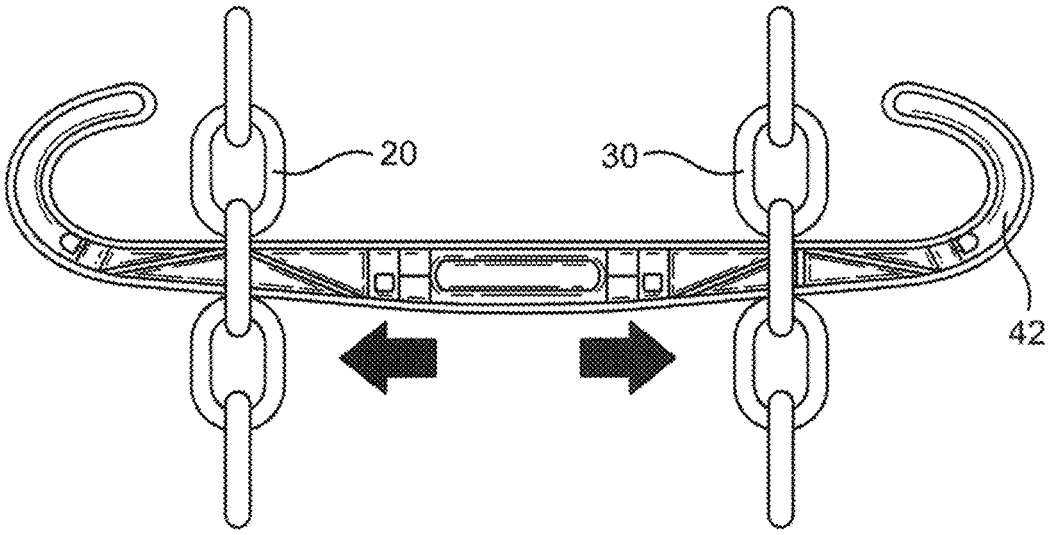
FIG. 5 (Prior Art)
FIG. 5 is a top view of a shoulder piece inserted into two chains within an organizer, in accordance with one embodiment.

As shown in FIG. 5, each of the shoulder pieces 42, 44 has at least two apertures 43*a*, 43*b*, one of the left and one on the right. At a minimum, those shoulder pieces of organizer 10 that are secured by ties 51, 52, 53, 54 to the chains 20, 30 have an aperture. In some embodiments, each of the apertures 43*a*, 43*b* in the shoulder pieces 42, 44 is situated at or close to where the elongated body 47 of the shoulder piece 42, 44 meets the arcuate ends 49 *a*, 49 *b* of the shoulder piece 42, 44.

In some embodiments, the apertures 43*a*, 43*b* of the shoulder pieces are made so that when the shoulder piece 42, 44 is in place having been inserted into the apertures defined by the links of chains 20, 30, this results in the apertures 43*a*, 43*b* of the shoulder pieces 42, 44 being situated adjacent to or within one centimeter of the respective shin link such as chain links 21, 29, 31, 39 of chains 20, 30.

FIG. 5 shows a shoulder piece 42 connected through a link in each of chains 20, 30.

Figure 6:
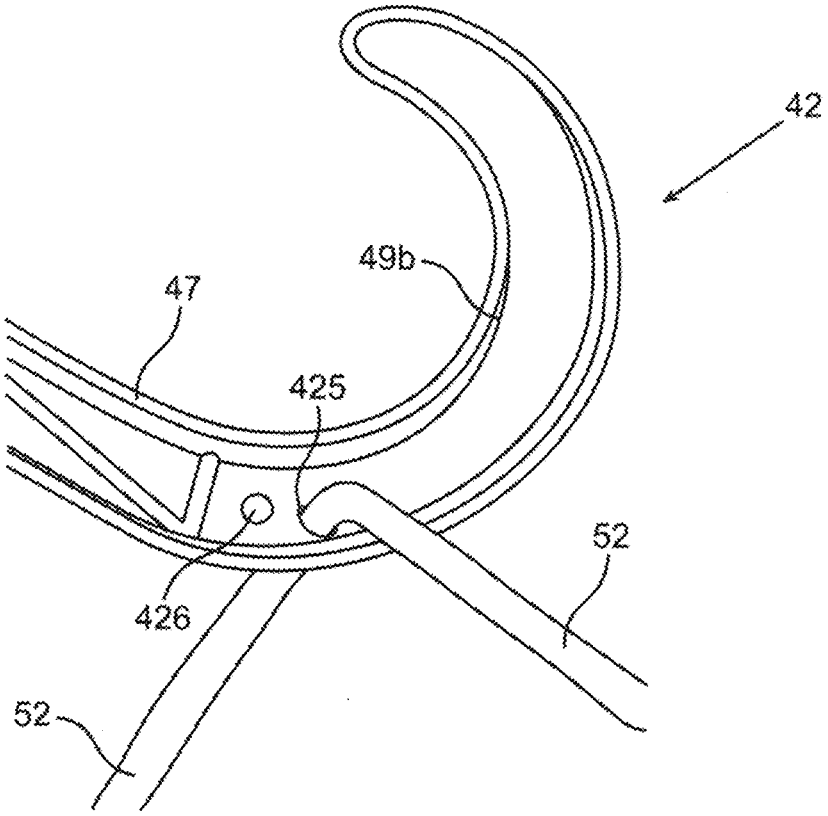
FIG. 6 shows a portion of a shoulder piece with a tie having been inserted into an aperture in the shoulder piece, in accordance with one embodiment.

FIG. 6 depicts part of the elongated body 47 of a shoulder piece 42 together with an arcuate end 49*b*. The second twist tie 52 has been inserted into an aperture 425 in this shoulder piece 42. Note that there is a second aperture 426 to the left of the aperture 425 through which the tie 52 has been inserted—this second aperture 426 is configured for an optional elastic cord (not shown).

Each of the twist ties, including the first twist tie 51, the second twist tie 52, the third twist tie 53 and the fourth twist tie 54, are made from a material that is configured to inelastically deform.

Figure 7:
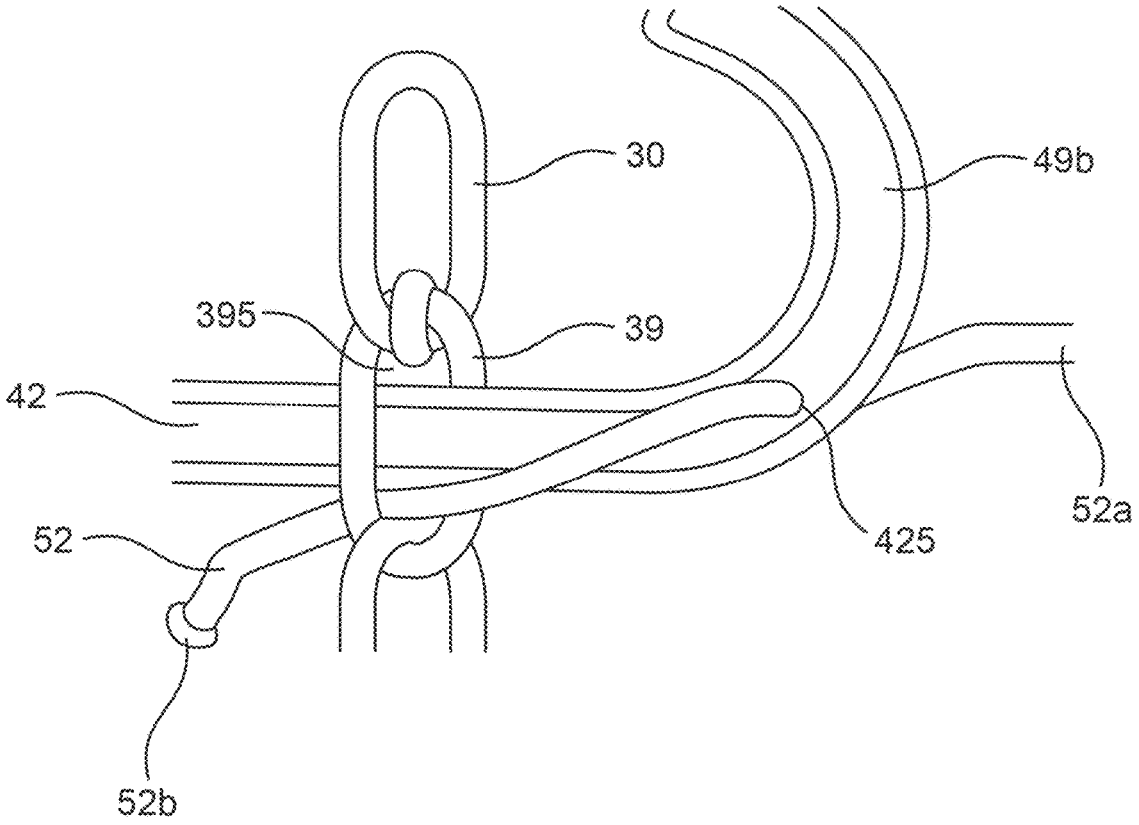
FIG. 7 shows a portion of a shoulder piece with a tie having been inserted into an aperture in the shoulder piece and also having been pushed through an aperture of a link of a chain, in accordance with one embodiment.
Figure 8:
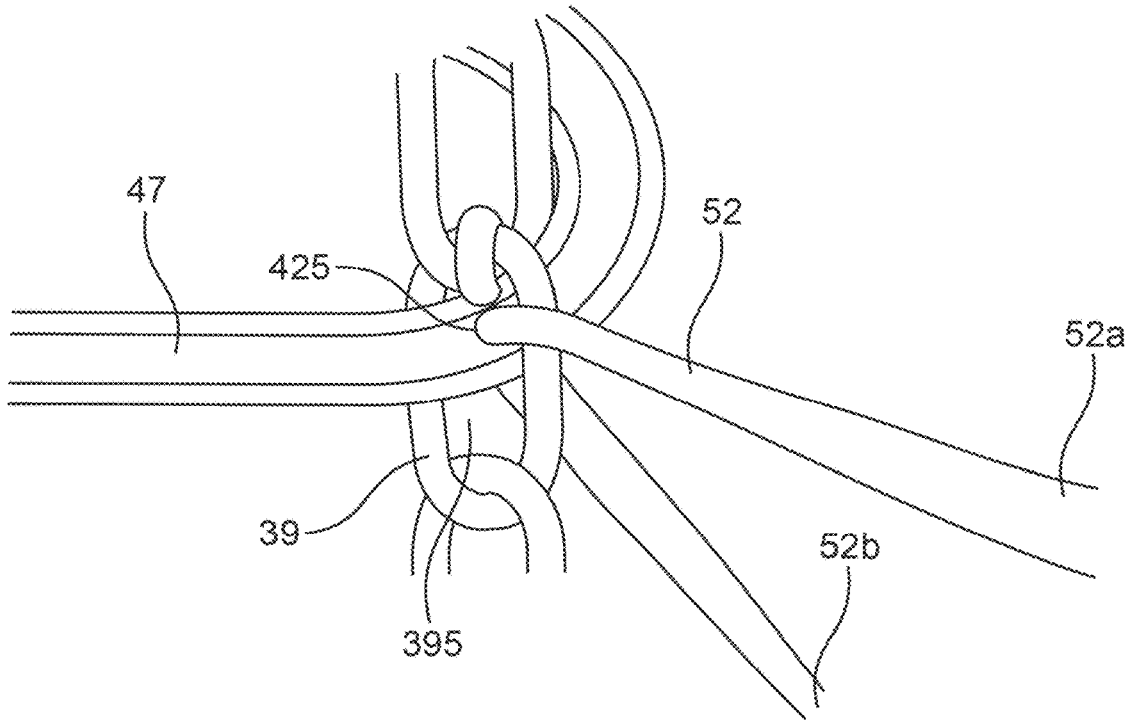
FIG. 8 is similar to FIG. 7 except it shows that the aperture in the shoulder piece has been aligned with the aperture in the chain link, in accordance with one embodiment.

As shown in FIG. 6, one end of a particular twist tie 52 may be manually bent to the extent necessary to have that twist tie 52 be inserted into an aperture 425 in the shoulder piece (for example the lowermost shoulder piece 42). As shown in FIG. 7, one end 52*a* of the twist tie 52 has been pulled through the aperture 425 in the shoulder piece 42 and also pulled the aperture 395 defined by the link 39 of second chain 30. As shown in FIG. 8, the ends 52*a*, 52*b* of tie 52 have been pulled and bent such that the aperture 425 in the shoulder piece 42 has been moved to the aperture 395 in the link 39 so as to firmly join the shoulder piece 42 to the particular chain link 39 that it traverses.

Figure 9:
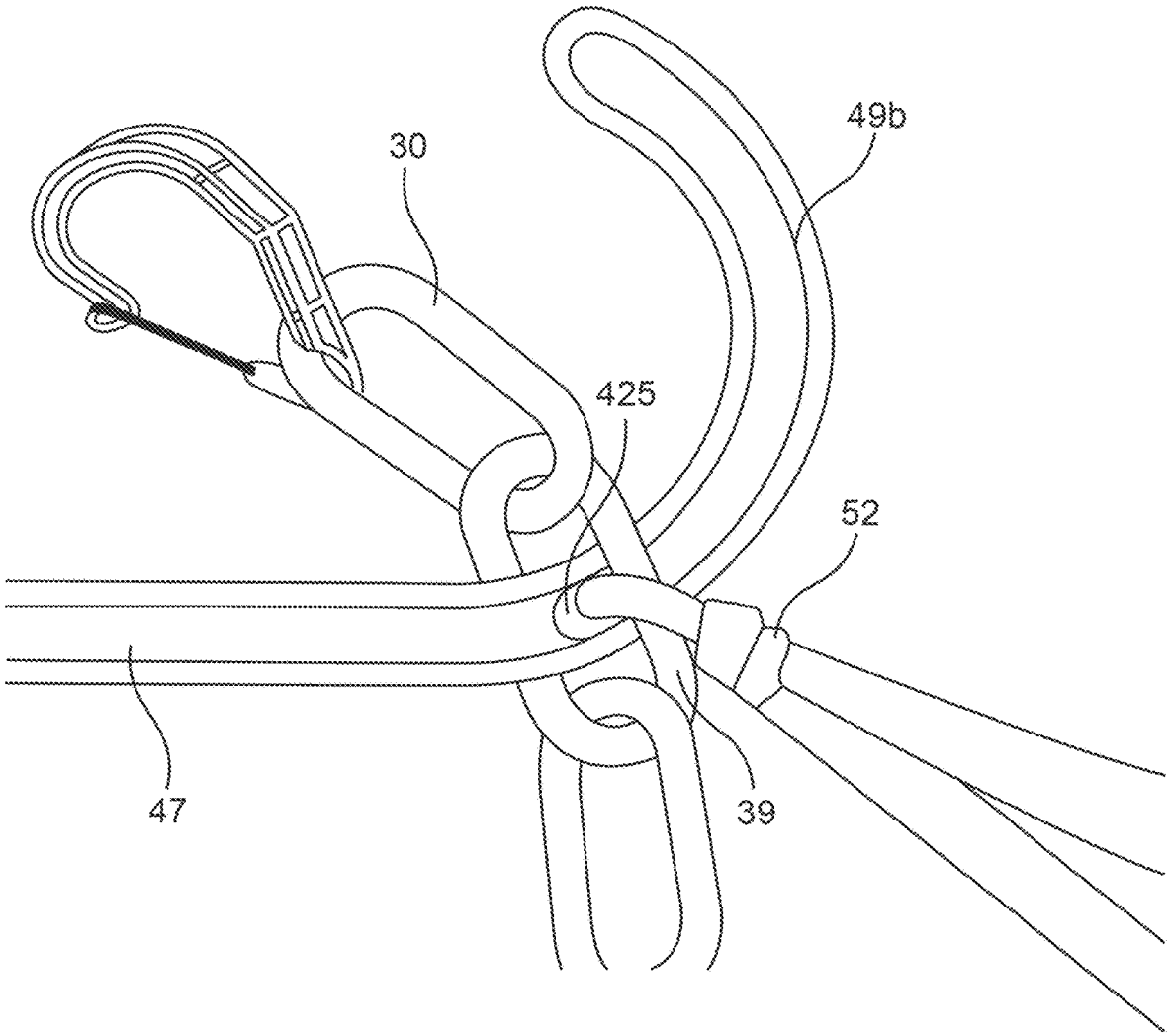
FIG. 9 shows end portions of the tie of FIG. 8 pulled back with its two ends twisted together to lock the shoulder piece to the chain, in accordance with one embodiment.

As shown in FIG. 9 both ends 52*a*, 52*b* of the twist tie 52 are wrapped around the chain link 39 and tied or twisted together to set the ends 52*a*, 52*b* in an unmovable, secure position.

In some embodiments, twist tie 51 attaches a first portion of the first twist to a second portion of the first twist tie. In addition, twist tie 52 attaches a first portion of the second twist tie to a second portion of the second twist tie. Similarly, twist tie 53 attaches a first portion of the third twist tie 53 to a second portion of the third twist tie. In addition, twist tie 54 attaches a first portion of the fourth twist to a second portion of the fourth twist tie.

In some embodiments, the uppermost shoulder piece is rigidly affixed by a first twist tie to the first chain and by a second twist tie to the second chain.

In some embodiments, a lowermost shoulder piece is rigidly affixed by a third twist tie to the first chain and by a fourth twist tie to the second chain.

In some embodiments, the first twist tie, the second twist tie, the third twist tie and the fourth twist tie are made from a material that is configured to inelastically deform so as to attach a first portion of the first twist tie to a second portion of the first twist tie, attach a first portion of the second twist tie to a second portion the second twist tie, attach a first portion of the third twist tie to a second portion of the third twist tie and attach a first portion of the fourth twist tie to a second portion of the fourth twist tie.

The first portion and second portion may be end portions or middle portions or any other portion of the twist ties.

In some embodiments, a first portion of the second twist tie traverses an aperture that the upper shoulder piece traverses and a second portion of the second twist tie traverses a space in a link of the second chain.

In some embodiments, a first portion of the third twist tie traverses an aperture that the lower shoulder piece of the lowermost shoulder piece assembly traverses and a second portion of the third twist tie traverses a space in a link of the first chain, wherein a first portion of the fourth twist tie traverses an aperture that the lower shoulder piece traverses and a second portion of the fourth twist tie traverses a space in a link of the second chain.

In some embodiments, at least one of the twist ties comprises helical steel.

In some embodiments, at least one or at least two or at least three or all four of the twist ties has a diameter of from 19 AWG to 31 AWG (0.2 mm to 0.9 mm). In one implementation, each of the first twist tie, the second twist tie, the third twist tie and the fourth twist tie has a diameter of from 19 AWG to 31 AWG (0.2 mm to 0.9 mm).

In some embodiments, each of the first twist tie, the second twist tie, the third twist tie and the fourth twist tie are made of a material configured to inelastically deform.

In some embodiments, the material is galvanized steel or aluminum.

In one particular implementation, each of the first twist tie, the second twist tie, the third twist tie and the fourth twist tie are made of a material having a Young's modulus of 190-210 GPa (gigapascals).

In one implementation, each of the first twist tie, the second twist tie, the third twist tie and the fourth twist tie are made of steel and have a Young's modulus of 190-210 GPa.

In one implementation, each of the first twist tie, the second twist tie, the third twist tie and the fourth twist tie are made of steel and have a Young's modulus of 195-205 GPa.

In one implementation, each of the first twist, the second twist tie, the third twist tie and the fourth twist tie are made of aluminum and have a Young's modulus of 60-80 GPa and wherein each of the first twist tie, the second twist tie, the third twist tie and the fourth twist tie are twisted with at least three twists.

In one implementation, each of the first twist tie, the second twist tie, the third twist tie and the fourth twist tie are made of aluminum and have a Young's modulus of 65-75 GPa and wherein each of the first twist tie, the second twist tie, the third twist tie and the fourth twist tie have been twisted multiple times using at least three twists.

In one implementation, each of the first twist tie, the second twist tie, the third twist tie and the fourth twist tie are made of aluminum and have a Young's modulus of 69-72 GPa and wherein each of the first twist tie, the second twist tie, the third twist tie and the fourth twist tie have been twisted multiple times using at least three twists.

In one implementation, each of the first twist tie, the second twist tie, the third twist tie and the fourth twist tie have been twisted multiple times using at least three twists.

In some embodiments, the uppermost shoulder piece assembly remains substantially in the plane when a torque of 10 newton meters (Nm) is exerted against a top portion of the organizer.

In some embodiments, the lowermost shoulder piece assembly remains substantially in the plane when a torque of 10 newton meters (Nm) is exerted against a bottom portion of the organizer.

In some embodiments, each of the shoulder pieces in the plurality of shoulder piece assemblies remains substantially in the plane when a torque of 10 newton meters (Nm) is exerted against any portion of the organizer.

In some embodiments, the organizer is rigid enough so that if a force of 40 Newtons is exerted frontally either at the first chain 20 or at the second chain 30 the organizer 10 is configured to move as a unit without any of the shoulder piece assemblies 40 or shoulder pieces 42, 44 moving out of the plane by more than an angle of more than 10 degrees to the plane.

In some embodiments, the organizer is configured to hold up to 85 pounds.

While the invention has been described with respect to a limited number of embodiments, it will be appreciated that many variations, modifications and other applications of the invention may be made. Therefore, the claimed invention, as recited in the claims that follow, is not limited to the embodiments described herein.

What is claimed is:

1. A modular organizer with two chains that has structural integrity, comprising:

a first chain running along a first vertical axis;

a second chain running along a second vertical axis substantially parallel to the first vertical axis, a plurality of shoulder piece assemblies separable from the first and second chains, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing apertures in corresponding links of the first and second chains, wherein the plurality of shoulder piece assemblies include an uppermost shoulder piece that traverses a left aperture of an upper link in the first chain and a right aperture in the upper link of the second chain and includes a lowermost shoulder piece that traverses a left aperture of a lower link in the first chain and a right aperture in the lower link of the second chain, the first chain, the second chain and the plurality of shoulder piece assemblies defining a plane containing the first vertical axis and the second vertical axis, the uppermost shoulder piece is rigidly affixed by a first twist tie to the first chain and by a second twist tie to the second chain, a lowermost shoulder piece is rigidly affixed by a third twist tie to the first chain and by a fourth twist tie to the second chain, wherein the first twist tie, the second twist tie, the third twist tie and the fourth twist tie are made from a material that is configured to inelastically deform so as to attach a first portion of the first twist tie to a second portion of the first twist tie, attach a first portion of the second twist tie to a second portion the second twist tie, attach a first portion of the third twist tie to a second portion of the third twist tie and attach a first portion of the fourth twist tie to a second portion of the fourth twist tie.

2. The organizer of claim 1, wherein the first twist tie traverses an aperture of the uppermost shoulder piece adjacent the upper link in the first chain while the uppermost shoulder piece traverses the upper link in the first chain, wherein the aperture in the uppermost shoulder piece is within a centimeter of an opening in the upper chain.

3. The organizer of claim 2, wherein the second twist tie traverses the right aperture in the upper link of the second chain.

4. The organizer of claim 1, wherein the second twist tie traverses the right aperture in the upper link of the second chain.

5. The organizer of claim 1, wherein the third twist tie traverses the left aperture of the lower link in the first chain.

6. The organizer of claim 5, wherein the fourth twist tie traverses the right aperture in the lower link in the second chain.

7. The organizer of claim 1, wherein the fourth twist tie traverses the right aperture in the lower link in the second chain.

8. The organizer of claim 1, wherein the lower link means the lowest link traversed by a shoulder piece.

9. The organizer of claim 1, wherein the upper link means the highest link traversed by a shoulder piece.

10. The organizer of claim 1, wherein a first portion of the third twist tie traverses an aperture that the lower shoulder piece of the lowermost shoulder piece assembly traverses and a second portion of the third twist tie traverses a space in a link of the first chain.

11. The organizer of claim 10, wherein a first portion of the fourth twist tie traverses an aperture that the lower shoulder piece traverses and a second portion of the fourth twist tie traverses a space in a link of the second chain.

12. The organizer of claim 1, wherein at least one of the twist ties comprises helical steel.

13. The organizer of claim 1, wherein at least one of the twist ties has a diameter of from 19 AWG to 31 AWG (0.2 mm to 0.9 mm).

14. The organizer of claim 1, wherein each of the first twist tie, the second twist tie, the third twist tie and the fourth twist tie has a diameter of from 19 AWG to 31 AWG (0.2 mm to 0.9 mm).

15. The organizer of claim 1, wherein the material is steel or aluminum.

16. The organizer of claim 1, wherein each of the first twist tie, the second twist tie, the third twist tie and the fourth twist tie are made of a material having a Young's modulus of 190-210 GPa.

17. The organizer of claim 1, wherein each of the first twist tie, the second twist tie, the third twist tie and the fourth twist tie are made of steel and have a Young's modulus of 190-210 GPa.

18. The organizer of claim 1, wherein each of the first twist tie, the second twist tie, the third twist tie and the fourth twist tie are made of steel and have a Young's modulus of 195-205 GPa.

19. The organizer of claim 1, wherein each of the first twist, the second twist tie, the third twist tie and the fourth twist tie are made of aluminum and have a Young's modulus of 60-80 GPa and wherein each of the first twist tie, the second twist tie, the third twist tie and the fourth twist tie are twisted with at least three twists.

20. The organizer of claim 1, wherein each of the first twist tie, the second twist tie, the third twist tie and the fourth twist tie are made of aluminum and have a Young's modulus of 65-75 GPa and wherein each of the first twist tie, the second twist tie, the third twist tie and the fourth twist tie have been twisted multiple times using at least three twists.

21. The organizer of claim 1, wherein each of the first twist tie, the second twist tie, the third twist tie and the fourth twist tie are made of aluminum and have a Young's modulus of 69-72 GPa and wherein each of the first twist tie, the second twist tie, the third twist tie and the fourth twist tie have been twisted multiple times using at least three twists.

22. The organizer of claim 1, wherein each of the first twist tie, the second twist tie, the third twist tie and the fourth twist tie have been twisted multiple times using at least three twists.

* * * * *